US007378594B2

(12) United States Patent
Bigelow et al.

(10) Patent No.: US 7,378,594 B2
(45) Date of Patent: May 27, 2008

(54) ELECTRICAL WIRE CONNECTOR DEVICE WITH VISUAL CONNECTION VALIDATION

(76) Inventors: Gwen F. Bigelow, 17255 Torrey Ct., Morgan Hill, CA (US) 95037; Samuel Anthony Doporto, 17255 Torrey Ct., Morgan Hill, CA (US) 95037

( * ) Notice: Subject to any disclaimer, the term of this patent is extended or adjusted under 35 U.S.C. 154(b) by 0 days.

(21) Appl. No.: 11/698,723

(22) Filed: Jan. 26, 2007

(65) Prior Publication Data

US 2007/0178752 A1 Aug. 2, 2007

Related U.S. Application Data

(60) Provisional application No. 60/764,098, filed on Feb. 1, 2006.

(51) Int. Cl.
*H01R 4/00* (2006.01)

(52) U.S. Cl. ..... 174/84 R; 174/87

(58) Field of Classification Search ..... 174/74 R, 174/74 A, 77 R, 84 R, 84 C, 87
See application file for complete search history.

(56) References Cited

U.S. PATENT DOCUMENTS 3,075,038 A * 1/1963 Schinske ..... 174/87
3,113,553 A * 12/1963 Schinske ..... 439/489
3,156,761 A * 11/1964 Schinske ..... 174/87
4,438,995 A * 3/1984 Fisher et al. ..... 439/147
4,924,035 A * 5/1990 Miller et al. ..... 174/87
5,286,067 A * 2/1994 Choksi ..... 285/38
5,399,810 A * 3/1995 Hayami ..... 174/84 R
5,922,994 A * 7/1999 Robinson et al. ..... 174/87
6,914,191 B2 * 7/2005 Leith et al. ..... 174/87

FOREIGN PATENT DOCUMENTS

JP 06-225422 * 8/1994

* cited by examiner

*Primary Examiner*—William H. Mayo, III
(74) *Attorney, Agent, or Firm*—Arielq S. Bentolila; Bay Area IP, LLC

(57) ABSTRACT

A connector apparatus for connecting a plurality of electrical wires of a standard size has a connector body having a cylindrical shape including an open end for accepting the wires, a closed end, an interior and an exterior surface. The connector body connects the wires and retains the wires in the interior when a twisting motion is applied to the connector body relative to an axis of the wires. The connector body is constructed of a transparent material that allows for visual inspection of the interior. A color marking for indicating the standard size of the wires is applied to a portion of the connector apparatus such that the interior remains visible for the visual inspection. A conductive coil can be positioned in a portion of the interior. The conductive coil has dimensions suitable for securely contacting the wires and aiding in the connecting of the wires.

16 Claims, 7 Drawing Sheets

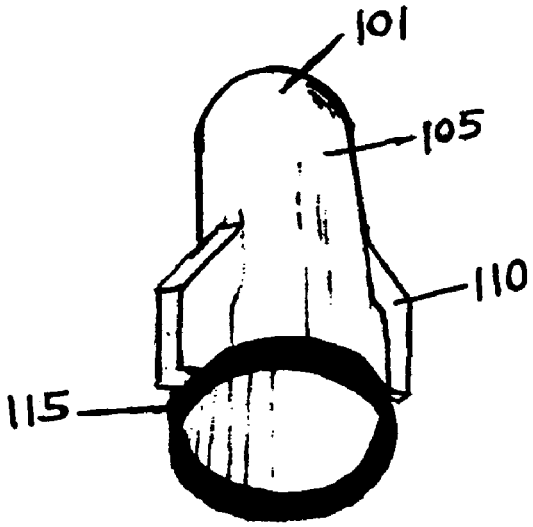
FIG. 1a
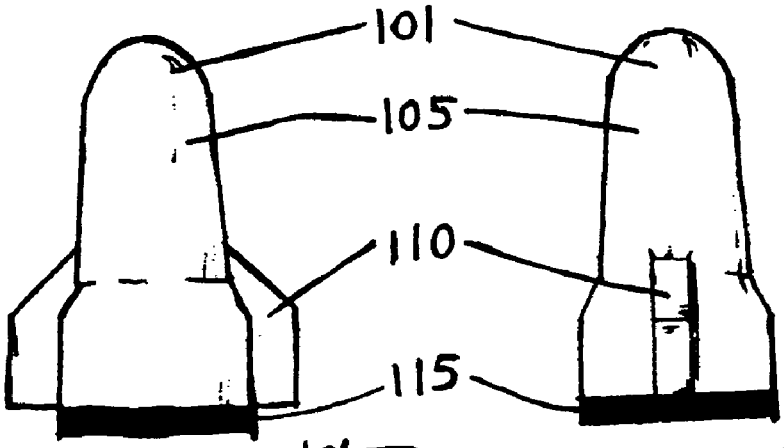
FIG. 1b
FIG. 1C
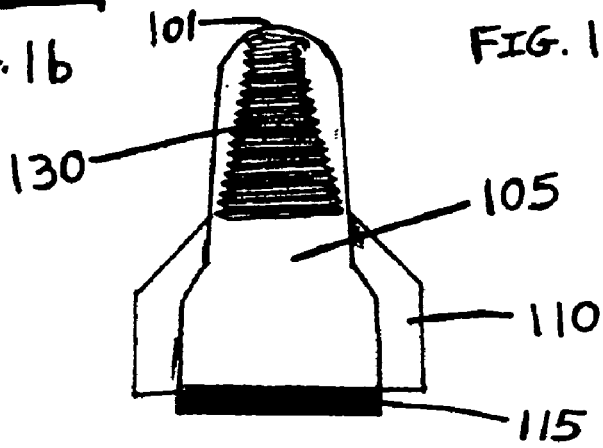
FIG. 1d (PRIOR ART)

ELECTRICAL WIRE CONNECTOR DEVICE WITH VISUAL CONNECTION VALIDATION

CROSS-REFERENCE TO RELATED APPLICATIONS

The present Utility patent application claims priority benefit of the U.S. provisional application for patent No. 60/764,098 filed on Feb. 1, 2006 under 35 U.S.C. 119(e). The contents of this related provisional application are incorporated herein by reference.

FIELD OF THE INVENTION

The present invention relates to electrical wire connectors. More particularly, the invention relates to a twist-on electrical wire connector that enables the user to visually see the electrical connection made inside the wire connector.

BACKGROUND OF THE INVENTION

Currently, there are no practical electrical wire connectors that allow a user to visually and clearly see the electrical connection on the spot in a twist-on or screw-on wire connector. Typical wire connectors are completely opaque, making it difficult or impossible for the user to see the wires inside in order to check the electrical connection or to see if one or more stripped wire ends have slipped out away from the other electrical wires being connected. Even if the user tries to look into the open end of the connector, the connection is difficult to see, due to the insulated wires taking up the only viewing area and the darkness inside a typical wire connector. Thus, a user cannot depend on knowing that he has made a proper and safe electrical connection with a typical wire connector. Known in the art is a clear tipped, push-on electrical wire connector that can connect a maximum of eight wires side by side in sizes of 18 to 12 gage for use only with solid, or stranded, copper wire and used in lighting & junction boxes. There has been no way previously in the art to use more than eight wires in the present clear-tipped push on wire connector or a method to ensure that the electrical current continues to flow through the circuit. Because of the design of these clear-tipped push on wire connectors, or any kind of push-on wire connectors, the actual stripped wires do not touch. They are held in place by a pressured metal piece that also completes the electrical connection. Due to the actual electrical conductors, not touching each other in the actual connection, if this clear tipped connector failed, for example, without limitation, if part of it broke, got crushed, or the pressured metal piece that holds the wires in place, weakened and wires started to slip out, the current would be broken. There is no known approach to validating a proper electrical connection within any king of push-on wire connector.

Known techniques addressing the foregoing problems are generally not cost effect. Moreover, known clear-tipped push on wire connectors cannot be used with wire larger than 12 gage, solid and stranded. Also, known clear-tipped push on wire connectors, have no practical application, other than fluorescent ballast lighting applications. There has been no prior-art twist on or screw on electrical wire connector through which the user can visually see the electrical connection or a twist on connection allowing the user to see that the conductive coil, which holds the insulated or non-insulated electrical conductors in place and helps the conductors twist as the wire connector is turned, is seated in to place and is not ready to fall out due to a faulty coil installation in the connector itself. There is also no existing method in the art to be able to see if one or more wire conductors is about to slip, or is slipping out of the bunch of wire conductors so that they may be fixed now, not later. There have been no prior art products, in a twist on or screw on electrical wire connector, that give apprentices, journeyman electricians, homeowners, general contractors, and everyone else that needs to connect two or more electrical wire conductors together, the confidence and assurance of knowing their electrical connection is safe and secure.

In view of the foregoing, there is a need for an inexpensive, twist-on electrical wire connector that allows the user to see the connection and ensures a proper connection.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1*a*, FIG. 1*b*, FIG. 1*c*, FIG. 1*d*, FIG. 1*e*, and FIG. 1*f* illustrate an exemplary transparent electrical connector, in accordance with an embodiment of the present invention. FIG. 1*a* is a perspective view. FIG. 1*b* is a front elevation view thereof, with the rear elevation view, being identical. FIG. 1*c* is a left side elevation view, thereof, with the right side elevation view, being identical. FIG. 1*d* is a front elevation view thereof, with the conductive coil shown in place. FIG. 1*e* is a top plan view thereof, and FIG. 1*f* is a bottom plan view thereof;

FIG. 2*a* shows a front view, and FIG. 2*b* shows a perspective view;

FIG. 3*a* shows a front elevation view of the conductive coil, and FIG. 3*b* is a top plan view of the conductive coil;

Figure 1E:
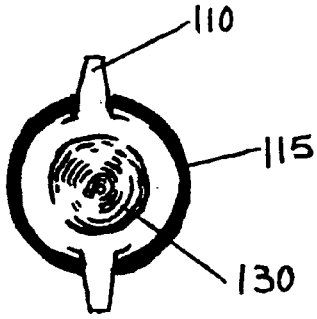

Unless otherwise indicated illustrations in the figures are not necessarily drawn to scale.

SUMMARY OF THE INVENTION

To achieve the forgoing and other objects and in accordance with the purpose of the invention, a variety of electrical wire connector devices with visual connection validation are described. Also a method of using the devices is shown and described.

In one embodiment, a connector apparatus for connecting a plurality of electrical wires of a standard size is described. A connector body having a cylindrical shape including an open end for accepting the wires, a closed end, an interior and an exterior surface is shown. The connector body connects the wires and retains the wires in the interior when a twisting motion is applied to the connector body relative to an axis of the wires. The connector body is constructed of a transparent material that allows for visual inspection of the interior. A color marking for indicating the standard size of the wires is applied to a portion of the connector apparatus such that the interior remains visible for the visual inspection. In another embodiment, a conductive coil is positioned in a portion of the interior, the conductive coil having interior dimensions suitable for securely contacting the wires and aiding in the connecting of the wires. In yet another embodiment, the color marking is a tinting of the conductive coil. In another embodiment, the color marking is a band at the open end. In still another embodiment, opposing wings on the exterior surface aid in applying the twisting motion. In a further embodiment, the color marking is applied to the wings. In yet another embodiment, the closed end is a rounded end. In a further embodiment, the color marking is applied to the rounded end.

In another embodiment, a connector apparatus means for connecting a plurality of electrical wires of a standard size is shown. The connector apparatus includes a connector body means for connecting the wires and providing visual inspection of the connected wires and a color marking means for identifying the standard size of the wires. In a further embodiment, the connector apparatus means includes a conductive coil means for aiding in the connecting of the wires.

In another embodiment, a method of connecting a plurality of electrical wires of a standard size is described. The method includes the steps of securely holding the electrical wires approximate to an end of the wires where the wires have been stripped, choosing a transparent electrical connector having a color marking indicating the size of the wires, inserting the ends of the wires into the transparent electrical connector, twisting the transparent electrical connector relative to the wires to securely connect the wires and retain the wires in the electrical connector, and visually inspecting the wires through the transparent electrical connector to ensure the wires are properly connected.

Other features, advantages, and objects of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognized a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternatives embodiments do not necessarily imply that the two are mutually exclusive.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Some embodiments, described in some detail below, of the present invention enable, in many applications, the user to see that he has made a solid electrical connection, confidence of a proper connection, and safety while saving time and money. Some embodiments are implemented as a cylindrical shape that tapers down to a rounded closed end, while the other end is open, for evenly stripped electrical insulated or non insulated conductors to enter the coned shaped cylinder. Other embodiments are a completely transparent insulating cap, a completely smooth outer shell, a rounded smooth top, and smooth wings on opposing sides of the body for way gripping and turning. Preferred embodiments of the present invention implement a color-coding scheme for proper identification of wire connector size. The present invention may be made in various sizes including, but not limited to, all standard wire connector sizes. Standard connector sizes and their coordinating colors are small blue for gauge wire # 22 to #16, orange for # 22 to # 14, yellow for # 18 to # 12, red for # 18 to # 10, gray for # 14 to # 8, and large blue for # 14 to # 6 gauge wire. Another embodiment of the present invention implements a conductive coil that is inserted into the open end of the wire connector, and seated all the way up into the tapered and closed end of the body, to help turn and hold the electrical conductors in place for proper electrical connection.

Figure 1F:
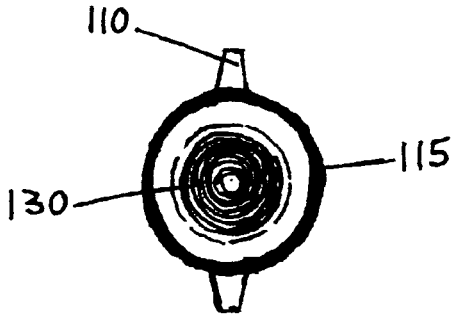

FIG. 1*a*, FIG. 1*b*, FIG. 1*c*, FIG. 1*d*, FIG. 1*e*, and FIG. 1*f* illustrate an exemplary transparent electrical connector, in accordance with an embodiment of the present invention. FIG. 1*a* is a perspective view. FIG. 1*b* is a front elevation view thereof, with the rear elevation view, being identical. FIG. 1*c* is a left side elevation view, thereof, with the right side elevation view, being identical. FIG. 1*d* is a front elevation view thereof, with a conductive coil shown in place. FIG. 1*e* is a top view thereof, and FIG. 1*f* is a bottom plan view thereof. The present embodiment electrically connects two or more wire conductors of any kind together, using a twisting or turning motion, to install the clear wire connector to make the electrical connection, and does not require any kind of crimping tool, or any other tool to make the electrical connection. The preferred embodiment of the present invention is a coned shaped cylinder that tapers down to a closed, rounded tip 101 to avoid any rough or sharp edges, while the other end is open for evenly stripped electrical insulated or non insulated conductors to enter the cone shaped cylinder, and has a completely transparent insulating shell 105. Shell 105 is also completely smooth, to insure perfect vision, for full viewing of the electrical connection. Shell 105 is insulated, to protect the user from incidents such as, but not limited to, wire exposure, fire, shorts and electrical shock.

The connector also has a color-coded identification band 115, shown at the very bottom, and straight, opposing wings 110 that aid the user in twisting the connector onto electrical wires. Wings 110 are on completely opposing sides and are for the user to hold the connector with his thumb and forefinger. In the present embodiment identification band 115 starts approximately ⅛" from the bottom of shell 105 and continues to the bottom of shell 105. Identification band 115 is made of an insulated hard plastic, like shell 105, except with color added. Alternatively, identification band 115 could be made out of rubber material, if the color band was at the bottom of the nut, similar to 3m c-28 model. Examples of materials that would be suitable for shell 105 and identification band 115 are, without limitation, strong thermoplastics, polyethylene terephthalate (PET or PETE), polystyrene (PS), polycarbonates, acrylics, abs, lexan products, vinyl, nylon, or any material that is completely transparent. The present embodiment is completely transparent except for color-coding identification band 115. In some embodiments, there may be a colored spot, dot, line, stripe, or other identifying mark on or surrounding the connector that would identify the size of the connector, see FIG. 6-*thru* FIG. 17 below. The color-coding, identification area may be anywhere on the inside or outside of the clear shell that does not obstruct the viewing of the actual electrical connection.

In the present embodiment, conductive coil 130 is inserted into the open end of the connector and seated all the way up to the tapered end of shell 105. Conductive coil 130 has a tapered end 120 and an open end 125 where the wires are inserted. Conductive coil 130 is stationary and does not unscrew when wires are removed or added into the wire connector. Conductive coil 130 helps to turn the tripped ends of the electrical wires and hold the wires in place for a proper electrical connection. In some embodiments, a part of or the entire conductive coil 130 may be tinted to identify the size of the connector.

The transparency or degree of clearness of shell 105 and rounded tip 101 allow the user to clearly see the electrical wire connection through shell 105 as the connection is made. The present embodiment can be adapted to all existing or upcoming twist on wire connectors. In order to make the present embodiment, the process of plastic injection molding, or any similarly suitable manufacturing process, would be used, and, within the process, the standard colored thermoplastic would be replaced with a completely transparent thermoplastic, such as, but not limited to, polyethylene terephthalate, also known as PET or PETE, polycarbonates, lexan products, or any other suitable hard, clear plastic. In the preferred embodiment, the last ⅛" of the open end of shell 105 is made of a similar hard plastic, but with color added, to create identification band 115, which identifies the wire connector size. In alternate embodiments the colored identifier may be in another form such as, but not limited to, a dot, a spot, a stripe, a line, or a tinted coil 130 inside of shell 105. The thermoplastic could also be injected with a UV protection stabilizer to protect the plastic and the components inside, for example, without limitation, coil spring 130 and wire conductors. In the present embodiment, a completely transparent, hard plastic is used to be able to visually and clearly see the electrical connection as the connection is being made and to ensure a safe, confident, and trouble free connection.

The present embodiment can be used in any application that involves just one electrical conductor. For example, without limitation, a user may be working on a junction box, that will later hold a device, such as, but not limited to, a receptacle or switch, and the user may need to turn the power back on before he is finished, leaving tailed hots, neutrals, and grounds exposed where someone could come into contact with then, not knowing that they are powered. In this case the user could use the present embodiment of the invention, not only to see clearly connected electrical connections, but also as a protective cap to place over the powered electrical wires in the junction box, so if someone came into contact with the wires, they would not be electrocuted. For this purpose, the user would place the wire connector over the single electrical conductor and simply turn, in a clockwise position, two full 360-degree turns to ensure that the connector will not fall off of the electrical conductor.

The present embodiment can also be used in any application that involves two or more electrical insulated, non-insulated, grounded, grounding, non-grounded, low voltage or high voltage conductors using copper solid and stranded wires ranging in size from # 22 gauge through # 6 gauge. The present embodiment can also be used by anybody, anywhere, that is trying to connect or join two or more electrical wires together, professionally or privately such as, but not limited to apprentice and journeyman electricians, general contractors, handymen, handywomen, homeowners, do it yourselfers, interior decorators, lighting stores, factories, and anybody involved in any field of construction, including, but not limited to, residential, commercial, industrial, service, underground, demolition, and many more.

Figure 2A:
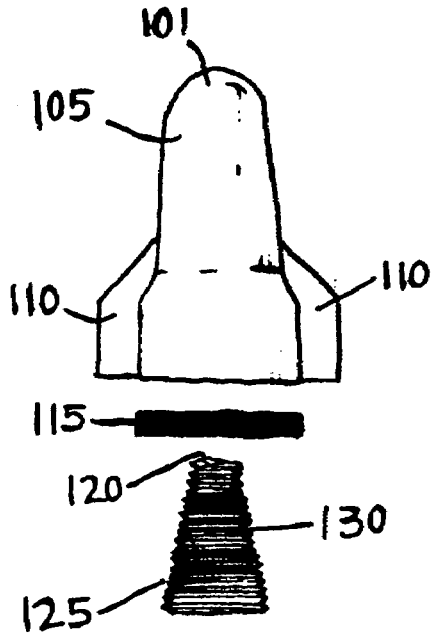
FIGS. 2*a* and 2*b* illustrate exploded views of an exemplary transparent electrical connector, in accordance with an embodiment of the present invention.
Figure 2B:
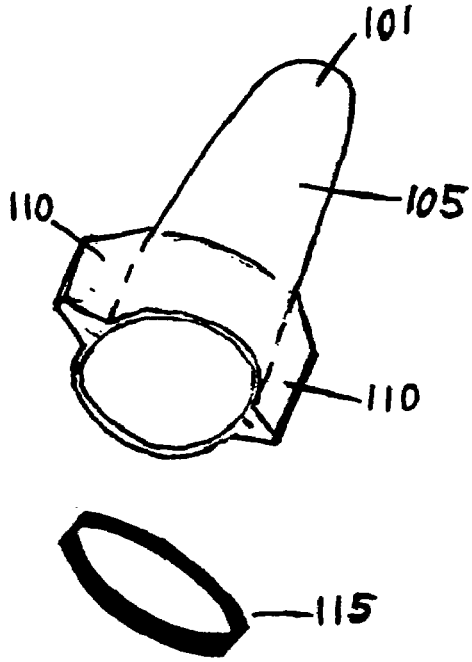
Figure 2B:
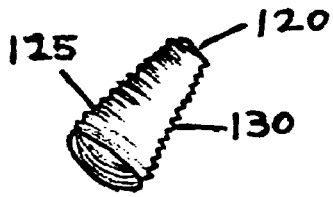

FIGS. 2*a* and 2*b* illustrate exploded views of an exemplary transparent electrical connector, in accordance with an embodiment of the present invention. FIG. 2*a* shows a front view, and FIG. 2*b* shows a perspective view. The individual components of the present embodiment include, without limitation, transparent insulated shell 105, color-coded identification band 115, conductive coil 130, with tapered end 120 and open end 125, rounded tip 101, and perfectly opposing, easy to grip wings 110.

Figure 3A:
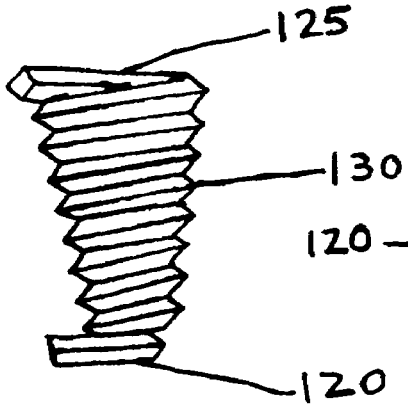
FIG. 3*a* and FIG. 3*b* illustrate an exemplary conductive coil from a transparent electrical wire connector, in accordance with an embodiment of the present invention.
Figure 3B:
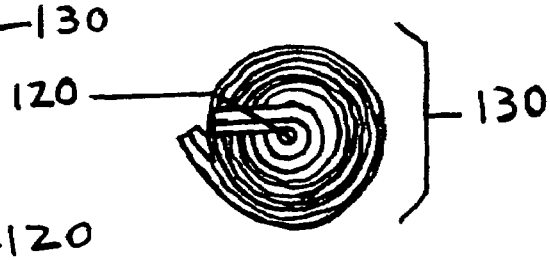

FIG. 3*a* and FIG. 3*b* illustrate an exemplary conductive coil 130 from a transparent electrical wire connector, in accordance with an embodiment of the present invention. FIG. 3*a* shows a front elevation view of conductive coil 130, and FIG. 3*b* is a top plan view of conductive coil 130. In the present embodiment, conductive coil 130 is placed inside clear shell 105, shown in FIGS. 1*a*, 1*b*, 1*c*, 1*d*, 1*e*, 1*f*, 2*a*, and 2*b*, to help turn the stripped ends of the electrical wires and to hold them in place. Conductive coil 130 is stationary and does not come out of shell 105 when the wire connector is unscrewed to remove or add a wire conductor.

Figure 4:
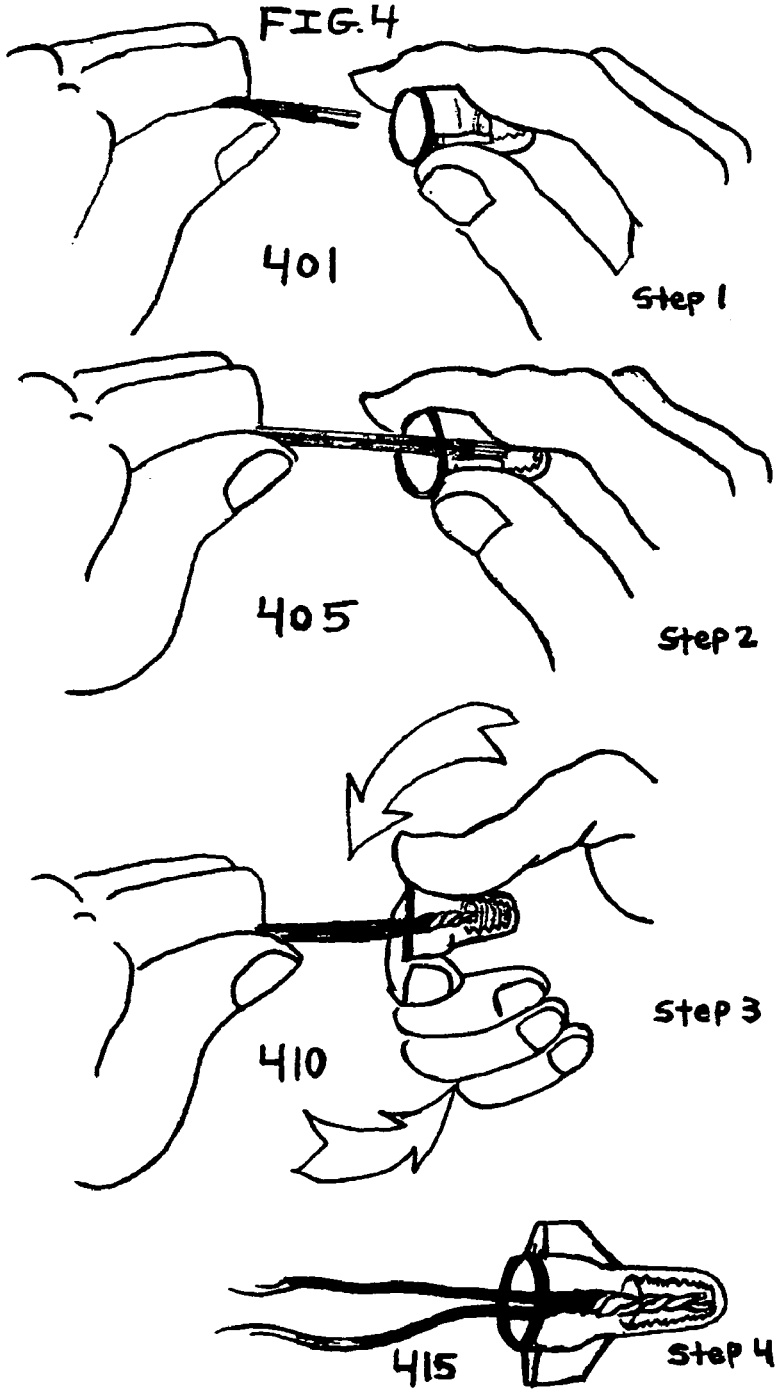
FIG. 4 illustrates exemplary steps a user would perform in order to connect electrical wires with a transparent wire connector, in accordance with an embodiment of the present invention.

FIG. 4 illustrates exemplary steps a user would perform in order to connect electrical wires with a transparent wire connector, in accordance with an embodiment of the present invention. In step 401, the user is holding two evenly stripped electrical wires evenly and tightly with the left thumb and forefinger, while he holds the transparent wire connector with the right thumb and forefinger. The wire connector was chosen by the color band to match the size of the wires. Next, in step 405, the user holds the two evenly stripped electrical wires evenly and tightly with the left thumb & forefinger, assuring enough room was left between the end of the stripped wires and the user's fingers to be able to have the stripped section of the two wires completely inserted into the transparent wire connector. The ends of the stripped wires are able to touch the farthest point of the tapered end of the conductive coil without the user releasing the thumb/forefinger hold on the wires. In step 410, the user completes the connection by holding the right thumb and forefinger in place on the wire connector and turning the wire connector in a clockwise rotation until he can visually see two twists in the insulated area of the electrical wire. In step 415, after a visual inspection of the wire connection, the wire connection is a successfully completed, safe, by the book electrical connection. More than two wires may be connected at the same time, or the wire connectors may be used as a protective cap for a single wire conductor to protect the wire from the elements and to protect people and the elements from the possibly hot wire conductor. The maximum number of wires that a connector will be able to hold is dependant on the size of the connector, but all wire connectors have a 600-volt maximum voltage.

Figure 5:
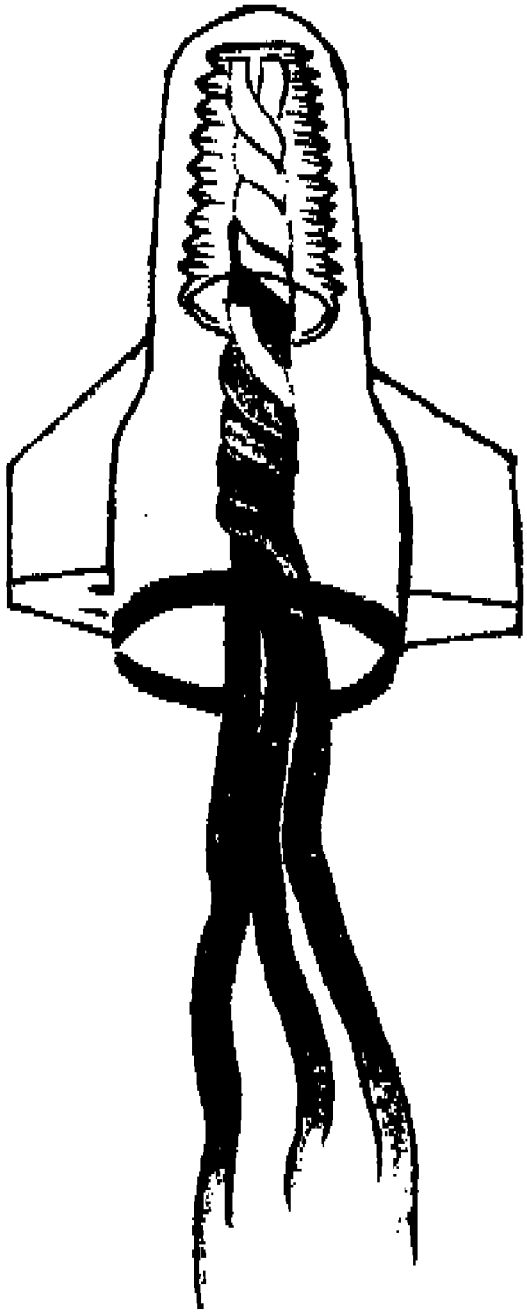
FIG. 5 illustrates an example of a bad connection seen through a transparent wire connector, in accordance with an embodiment of the present invention.

FIG. 5 illustrates an example of a bad connection seen through a transparent wire connector, in accordance with an embodiment of the present invention. The user would not be able to see this bad connection in typical twist on wire connectors FIG. 19. A bad electrical connection may happen for a number of reasons, for example, without limitation, if the user's left thumb and forefinger are not holding the stripped electrical wire tightly and evenly in place, when the user places the wire connector over the stripped ends of the electrical wires, one or more of the electrical wires can slip out of place losing connection with the rest of the electrical wires without the user knowing. This can also happen for various other reasons, such as, but not limited to, too many wires being made-up in a wire connector that is too small, or too large of wires in the wrong size wire connector, the right size wire connector should always be used for the job. The present embodiment takes away the guesswork by allowing the user to clearly see that he has made a safe and secure electrical connection, on the spot without wasting time and money, coming back to the job to troubleshoot a problem, or risking a fire due to a bad connection. A bad connection, as shown in the figure, can cause an electrical direct short, where the hot wire slips out of the wire connector and makes contact with the ground or neutral wire in the junction box, or a resistive short, where the hot wire or neutral wire (with a load) slips out of the wire connector but is still barely making contact with the rest of the wires in that wire connector causing heat that can very easily combust into a fire.

A qualified journeyman field test on wire make-up with a typical wire connector without a transparent shell would be as follows. First, the electrician would make a "by the book" electrical connection, refer to FIG. 4. Second, the electrician would, pull on each wire separately to check for a loose wire that didn't make the completed connection. Many times an electrician can perform this test, and, because the insulated part of the wires are twisted past the stripped part of the electrical wires, a wire can seem in place and tight and not budge when pulled on, but may not be making the electrical connection. This test is one of a few things electricians can do to try and be safe when using a typical wire connector, but it is still guesswork, not a solution. Third, the electrician would make a visual test. This includes, trying to move the insulated part of the electrical wires out of the way enough to see inside, the bottom opening of a typical wire connector FIG. 18, looking for a possible slipped wire or any other bad electrical connection. This test is difficult, due to the insulated wires, taking up the viewing area and the darkness inside a typical wire connector FIG. 18. With a typical wire connector, the electrician cannot see if there is a wire that has slipped out due to bad placement when wires were being inserted, into the wire connector or a weakened stripped piece of copper in a wire that has broken or is about to break, or just a bad connection. The electrician can also not see if the conductive coil is ready to fall out of its seated position with a typical connector FIG. 19, which, if the coil were to fall out, the coil would actually detach from the protective, insulated shell leaving no protection for the wires. The transparency of the present embodiment takes away this guesswork and allows the electrician to clearly see if the wires have connected properly within the connector.

Color coding identification band 115, shown in FIGS. 1*a*, 1*b*, 1*c*, 1*d*, 1*e*, 1*f*, 2*a*, and 2*b*, is a way for the user to know what size of wire connector he needs for his specific application; it shows industry standard colors on a band 115 on the wire connector. Each color represents a different sized wire connector that can hold specific sizes of wires and wire, and a specific number of wire conductors. Moreover, it should be noted that, for example, a yellow can hold up to 3 # 12 awg wires, and a minimum of 2 # 18 awg wires. Even though an electrician would not typically use a yellow for # 12 awg wire, they would use a red, except if they had more than 5 # 12 awg wires, in which case they would typically use a gray or blue, you can check the wire connector sizing chart, found on the back of any bag or box of wire connectors. In alternate embodiments, identification band 115 may be replaced by a number of different options. Some examples of alternative size identification methods, without limitation, are shown in FIGS. 6-17 and are described below. Transparent wire connectors may also be made in a variety of shapes and sizes, and some examples, without limitation, of different shapes are also shown in FIGS. 6-17 and described below. Those skilled in the art, in light of the present teaching, will recognize that there are multiple alternative shapes and identification methods for implementing a transparent wire connector including, but not limited to, different combinations of the exemplary shapes and identification methods shown in FIGS. 6-17. Although in the figures it looks like the different types of connectors also have different types of conductive coils like springs or clamps, etc., it is not meant to. That is, depending on the size wire nut, the coil spring is generally made to fit the diameter of the shell and to fit the amount of wire size and amount of wires allowed. In some alternate embodiments, another coil spring, may be used that require lineman pliers to remove the wire connector. In such alternate embodiments the coil spring usually comes out with the wires still twisted inside it. This is thought to be intended to make the connector single use. For the coil spring typically found inside most current wire connectors, and that of the present embodiment, if the wire nut has been used with the wrong size wire or to many wires, the coil spring stretches, and will not be useable again, it will just keep on turning.

Figure 6:
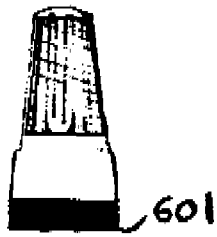
FIG. 6 shows an example of a typical wire nut type electrical connector with a transparent shell, in accordance with an embodiment of the present invention.

FIG. 6 shows an example of a typical wire nut type electrical connector with a transparent shell, in accordance with an embodiment of the present invention. This embodiment is cylindrical in shape and does not have a rounded tip. This embodiment also has a color-coding identification band 601 at the bottom of the shell.

Figure 7:
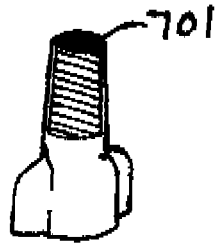
FIG. 7 shows an example of a typical wing nut type electrical connector with a transparent shell, in accordance with an embodiment of the present invention.

FIG. 7 shows an example of a typical wing nut type electrical connector with a transparent shell, in accordance with an embodiment of the present invention. In the present embodiment, there is a color-coding identification marker 701 on top of the shell. Identification marker 701 is a colored spot on the top of the connector. The shape of this type of connector is cylindrical with wings, and the connector does not have a rounded tip.

Figure 8:
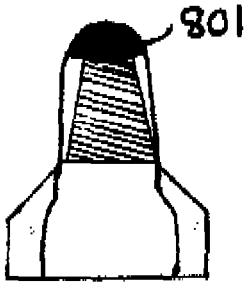
FIG. 8 shows an exemplary smooth, round-tipped electrical wire connector with a transparent shell, in accordance with an embodiment of the present invention.

FIG. 8 shows an example of a smooth round-tipped electrical connector with a transparent shell, in accordance with an embodiment of the present invention. This embodiment in similar to the preferred embodiment except that the size of the connector is indicated by a color-coding identification marker 801 on the top of the shell instead of an identification band on the bottom of the shell. Identification marker 801 is a colored spot on the rounded tip of the connector.

Figure 9:
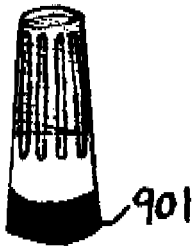
FIG. 9 shows an example of a typical wire twist type electrical connector with a transparent shell, in accordance with an embodiment of the present invention.

FIG. 9 shows an example of a typical wire twist type electrical connector with a transparent shell, in accordance with an embodiment of the present invention. In the present embodiment, a color-coding identification band 901 is on the bottom of the shell. This type of connector is cylindrical in shape without a round tip. Instead of wings, the present embodiment has groves in the shell that assist the user in turning the connector.

Figure 10:
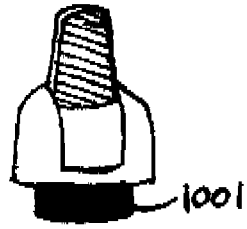
FIG. 10 shows an example of a typical twister pro type electrical connector with a transparent shell, in accordance with an embodiment of the present invention.

FIG. 10 shows an example of a typical twister pro type electrical connector with a transparent shell, in accordance with an embodiment of the present invention. This embodiment has a long color-coding identification collar 1001 at the bottom of the shell. This type of connector is cylindrical in shape with wings on opposing sides.

Figure 11:
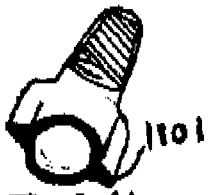
FIG. 11 shows an example of a typical 3M 312 type electrical connector with a transparent shell, in accordance with an embodiment of the present invention.

FIG. 11 shows an example of a typical 3M 312 type electrical connector with a transparent shell, in accordance with an embodiment of the present invention. In the present embodiment, a color-coding identification area 1101 covers the thickness of the body at the very bottom of the shell. Identification area 1101 may be on the inside of the material making up the body of the connector. The present embodiment is smooth and cylindrical with a tapered, rounded tip. This type of connector also had wings on opposing sides of the bottom of the shell.

Figure 12:
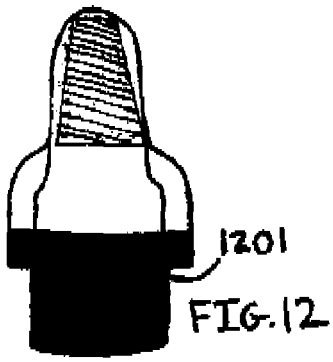
FIG. 12 shows an example of a typical 3M c-28 type electrical connector with a transparent shell, in accordance with an embodiment of the present invention.

FIG. 12 shows an example of a typical 3M c-28 type electrical connector with a transparent shell, in accordance with an embodiment of the present invention. The present embodiment has a color-coding identification skirt 1201 on the bottom of the shell. Identification skirt 1201 is a soft rubber skirt, in the color coordinating with the size of the connector. Identification skirt 1201 is located on bottom of shell of the connector from the bottom portion of the wings to the open end of the shell. The present embodiment is smooth and cylindrical with a tapered, rounded tip and wings on opposing sides of the bottom of the shell.

Figure 13:
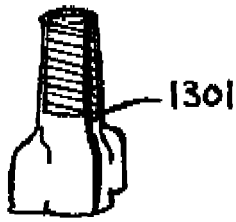
FIG. 13 shows an example of a typical wing nut type electrical connector with a transparent shell, in accordance with an embodiment of the present invention.

FIG. 13 shows an example of a typical wing nut type electrical connector with a transparent shell, in accordance with an embodiment of the present invention. This embodiment has a color-coding identification strip 1301. Identification stripe 1301 is a perpendicular stripe that starts at the top of the shell and ends at the bottom of the shell. This type of connector is cylindrical in shape with wings on the opposing sides of the bottom of the shell.

Figure 14:
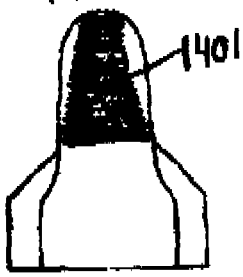
FIG. 14 shows an exemplary smooth round-tipped wire connector with a transparent shell, in accordance with an embodiment of the present invention.

FIG. 14 shows an exemplary smooth, round-tipped wire connector with a transparent shell, in accordance with an embodiment of the present invention. The present embodiment is similar to the preferred embodiment except that the size of the connector is indicated by tinting a conductive coil 1401 to the color that corresponds with the size of the connector. Conductive coil 1401 is inside of the shell of the connector, but the color of conductive coil 1401 can be seen because the shell of the connector is transparent. Conductive coil 1401 also helps to twist the stripped ends of the electrical wires together and hold them in place to ensure a proper connection.

Figure 15:
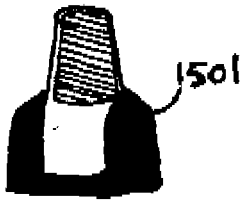
FIG. 15 shows an example of a typical twister pro type electrical connector with a transparent shell, in accordance with an embodiment of the present invention.

FIG. 15 shows an example of a typical twister pro type electrical connector with a transparent shell, in accordance with an embodiment of the present invention. This embodiment has color-coding identification wings 1501. Wings 1501 are tinted to be the color corresponding to the size of the particular connector and also help the user grip and twist the connector when connecting wires. The connector is cylindrical in shape and does not have a rounded tip.

Figure 16:
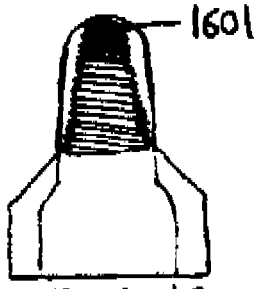
FIG. 16 shows an exemplary smooth, round-tipped wire connector with a transparent shell, in accordance with an embodiment of the present invention.

FIG. 16 show an exemplary smooth, round-tipped wire connector with a transparent shell, in accordance with an embodiment of the present invention. The present embodiment is similar to the preferred embodiment except that the color-coding identification is a tinted tip on conductive coil 1601. The location of the color on conductive coil 1601 is at the top tapered end of conductive coil 1601. The color can be seen by the user through the top rounded tip of the shell on the connector. Even through conductive coil 1601 is inside of the connector, the color can be seen by the user because of the transparency of the shell of the connector.

Figure 17:
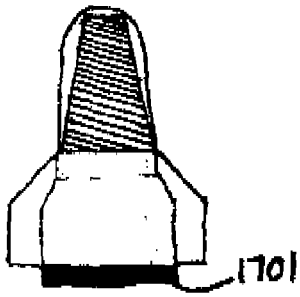
FIG. 17 shows an exemplary smooth, round-tipped wire connector with a transparent shell, in accordance with an embodiment of the present invention.

FIG. 17 shows an exemplary smooth, round tipped wire connector with a transparent shell, in accordance with an embodiment of the present invention. The present embodiment is similar to the preferred embodiment except that the color-coding identification is a short shirt 1701 at the bottom of the shell. Also the short shirt can be made out of any hard plastic or other hard material, or made from a rubber or flexible material of any kind.

Figure 18:
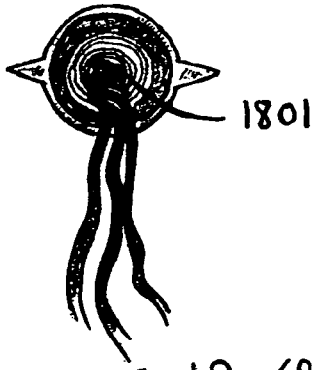
FIG. 18 (PRIOR ART)
FIG. 18 shows an example of a typical prior art wing nut type electrical wire connector, bottom plan view, and its disadvantages.

FIG. 18 shows an example of a typical prior art, wing nut type electrical wire connector, bottom plan view, and its disadvantages, due to the insulated wires, taking up the only viewing area, and the solid color filled wire connector, making the view area dark, you can not visually see a possible bad connection.

Figure 19:
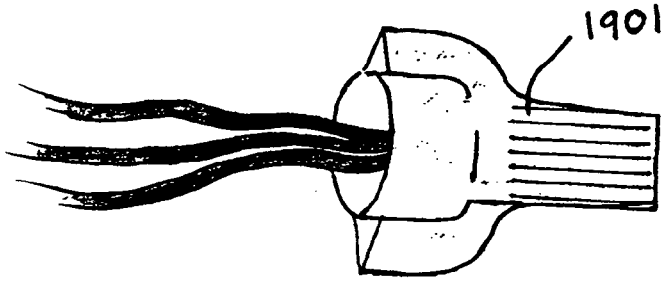
FIG. 19 (PRIOR ART)
FIG. 19 shows an example of a typical prior art wing nut type electrical wire connector, front, side plan view, and its disadvantages.

FIG. 19 shows an example of an typical prior art, wing nut type electrical wire connector, side plan view, and its disadvantages, due to the wire connector being of solid filled color, you can not view a badly seated coil, or a possible bad connection.

Figure 20:
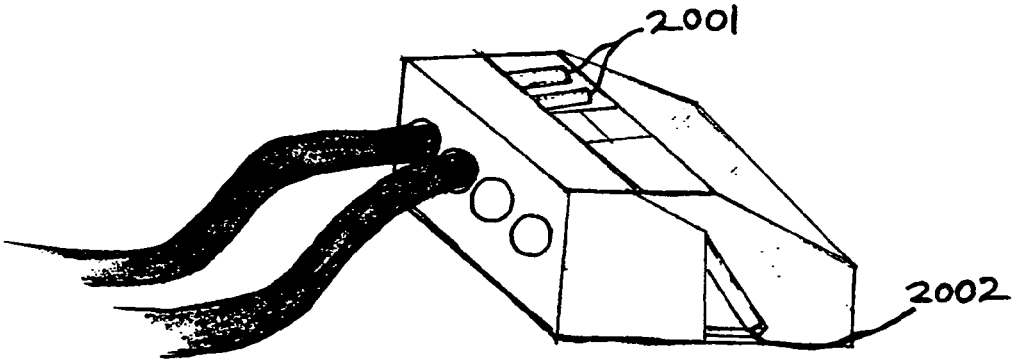
FIG. 20 (PRIOR ART) (PRIOR ART)
FIG. 20 shows an example of a typical prior art, "wago" clear tipped push on wire connector, side perspective plan view, and its disadvantages.

FIG. 20 show an example of a typical prior art "wago" clear tipped push on electrical wire connector, and its disadvantages, due to the fact that it can not be used with wire larger than 12 gage, solid and stranded, no way to ensure that the electrical current will continue to flow through the circuit, due to the fact that the actual stripped wires do not touch 2001, they are held in place by a pressured metal piece 2002 that also completes the electrical connection, this design could fail at any time, and there is no practical application, other than fluorescent ballast lighting.

Having fully described at least one embodiment of the present invention, other equivalent or alternative methods of implementing an electrical wire connection that allows the user to see the connection, according to the present invention, will be apparent to those skilled in the art. The invention has been described above by way of illustration, and the specific embodiments disclosed are not intended to limit the invention to the particular forms or components disclosed therein. The invention is thus to cover all modifications, equivalents, and alternatives falling within the spirit and scope of the following claims.

What is claimed is:

1. A connector apparatus for connecting a plurality of electrical wires of a standard size, the apparatus comprising:

a connector body, said connector body comprising a cylindrical shape having an open end for accepting the wires, a closed end, an interior and an exterior surface, said connector body connecting the wires and retaining the wires in said interior when a twisting motion is applied to said connector body relative to an axis of the wires, said connector body constructed of a transparent material that allows for visual inspection of said interior;

a color marking where a color of said color marking indicates a number of the standard size electrical wires the apparatus can connect, said color marking applied to a portion of the connector apparatus such that said interior remains visible for said visual inspection.

2. The apparatus as recited in claim 1, comprising a conductive coil positioned in a portion of said interior, said conductive coil having interior dimensions suitable for securely contacting said plurality of wires and aiding in said connecting of the wires.

3. The apparatus as recited in claim 2, wherein said color marking is a tinting of said conductive coil.

4. The apparatus as recited in claim 1, comprising opposing wings on said exterior surface for aiding in applying said twisting motion.

5. The apparatus as recited in claim 4, wherein said color marking is applied to said wings.

6. The apparatus as recited in claim 1, wherein exterior surface includes groves to aid in applying said twisting motion.

7. The apparatus as recited in claim 1, wherein said color marking is a band at said open end.

8. The apparatus as recited in claim 1, wherein said color marking is applied to a portion of a surface of said interior.

9. The apparatus as recited in claim 1, wherein said exterior surface is smooth for a clear visual inspection.

10. The apparatus as recited in claim 1, wherein said cylindrical shape is cone shape.

11. The apparatus as recited in claim 1, wherein said closed end comprises a rounded end.

12. The apparatus as recited in claim 11, wherein said color marking is applied to said rounded end.

13. The apparatus as recited in claim 1, wherein said transparent material is a transparent thermoplastic.

14. A connector apparatus means for connecting a plurality of electrical wires of a standard size, the means comprising:

a connector body means for connecting the wires and providing visual inspection of the connected wires; and a color marking means for identifying a number of the standard size wires the apparatus can connect.

15. The connector apparatus means as recited in claim 14, comprising a conductive coil means for aiding in said connecting of the wires.

16. A method of connecting a plurality of electrical wires of a standard size, the method comprising the steps of:

securely holding the electrical wires approximate to an end of the wires where the wires have been stripped;

using a transparent electrical connector having a color marking where a color of said color marking indicates a number of the standard size wires said connector can connect;

inserting the ends of the wires into said transparent electrical connector;

twisting said transparent electrical connector relative to the wires to securely connect the wires and retain the wires in said electrical connector; and visually inspecting the wires through said transparent electrical connector to ensure the wires are properly connected.

* * * * *